US012661548B2

(12) United States Patent
Livieri et al.

(10) Patent No.: US 12,661,548 B2
(45) Date of Patent: Jun. 23, 2026

(54) MOBILITY MECHANISM FOR HEALTHY EQUIPMENT

(71) Applicant: Johnson Health Tech. Co., Ltd., Taichung City (TW)

(72) Inventors: Shaun Livieri, Sun Prairie, WI (US); Donald E Stiemke, Madison, WI (US); Rick Mobley, Oregon, WI (US); Kuan-Ming Su, Taichung City (TW); Li Lin, Taichung City (TW)

(73) Assignee: Johnson Health Tech Co., Ltd., Taichung City (TW)

( * ) Notice: Subject to any disclaimer, the term of this patent is extended or adjusted under 35 U.S.C. 154(b) by 84 days.

(21) Appl. No.: 18/804,137

(22) Filed: Aug. 14, 2024

(65) Prior Publication Data

US 2025/0058167 A1 Feb. 20, 2025

(30) Foreign Application Priority Data

Aug. 18, 2023 (CN) ..... 202322230342.X

(51) Int. Cl.
*A63B 22/00* (2006.01)
*A63B 71/00* (2006.01)

(52) U.S. Cl.
CPC ..... *A63B 22/0046* (2013.01); *A63B 71/0036* (2013.01); *A63B 2225/093* (2013.01)

(58) Field of Classification Search
CPC ..... A63B 22/0046; A63B 71/0036; A63B 2225/093; A63B 21/068; A63B 22/0605; A63B 2071/025
See application file for complete search history.

(56) References Cited

U.S. PATENT DOCUMENTS

| | | | | |
|---|---|---|---|---|
| 1,686,894 | A * | 10/1928 | Buckert | B60B 33/06 16/33 |
| 2,768,835 | A * | 10/1956 | Hull | B60B 33/06 280/43.24 |
| 3,656,203 | A * | 4/1972 | Waflart, Jr. | B60B 33/0089 16/35 R |
| 12,007,065 | B2 * | 6/2024 | Ma | E04H 12/2238 |
| 12,043,062 | B2 * | 7/2024 | Herman | B60B 33/066 |
| 12,240,270 | B2 * | 3/2025 | Scalf | F25D 25/025 |
| 2018/0099180 | A1 * | 4/2018 | Wilkinson | A63B 71/023 |
| 2024/0066352 | A1 * | 2/2024 | Syrkin | A63B 23/0417 |
| 2024/0325819 | A1 * | 10/2024 | Adams | A61H 3/00 |

FOREIGN PATENT DOCUMENTS

CN 209733154 U 12/2019

* cited by examiner

*Primary Examiner* — Andrew S Lo

(57) ABSTRACT

A health equipment has at least one height-adjustable wheel set mounted on its bottom, so that the health equipment can be operated to move on a ground. Each height-adjustable wheel set has a swing seat that can be rotatable between a first angle and a second angle, a wheel that can be moved up or down along with rotation of the swing seat, and a pushing member that can be movable between a retracted position and an abutting position. When the pushing member rotates from the retracted position to the abutting position, the swing seat will rotate from the first angle to the second angle to lower the wheel to contact the ground. At the same time, a reaction force from the ground is applied to the pushing member in a direction corresponding to a rotational direction of the pushing member from the retracted position to the abutting position.

20 Claims, 11 Drawing Sheets

MOBILITY MECHANISM FOR HEALTHY EQUIPMENT

FIELD OF THE INVENTION

The present invention relates to health equipment. More particularly, the present invention relates to a mobility mechanism for health equipment.

DESCRIPTION OF THE RELATED ART

Common exercise equipment such treadmills or stair climber machines, or massage equipment such as massage chairs. Many models are bulky and heavy, so it is not easy to move them. For example, when a commercial treadmill that cannot be folded upward needs to be moved, the typical moving method is to have one or two staff lift the rear end of the treadmill so that the entire treadmill tilts forward, with only two ground wheels at the bottom of the front end contacting the ground to move or pull it to a desired position. Then, lower the rear end of the treadmill so that the left and right support feet at the bottom of the rear end are firmly positioned on the ground. Another moving method is to use a moving tool similar to a trailer (dolly) to lift the rear end of the treadmill so that the left and right support feet can be lifted away from the ground. Therefore, the treadmill can be moved to a desired position and then the trailer can be removed. Obviously, the first method is cumbersome, laborious, and relatively dangerous, while the second method requires the purchase of specific moving tools, both of which are inconvenient.

U.S. Pub. No. 2018/0099180 discloses an exercise machine that can be operated to move on the ground surface when necessary. The exercise machine (e.g. the treadmill) has a height adjustable caster assembly attached to the frame of the base. The height adjustable caster assembly includes a stationary portion rigidly connected to the base frame, a pivot arm pivotally connected to the stationary portion, and the wheel connected to the pivot arm. An adjustable urging member is connected to the stationary portion, which can apply a protruding force onto the pivot arm. The urging member may be a screw. In other examples, the urging member may be moved by a motor. When the urging member is adjusted so that the pivot arm is forced to rotate away from the stationary portion about the pivot, the wheel may move forward enough that the wheel contacts the support surface. The height adjustable caster assembly allows the user to adjust the position of the caster's wheel so that the wheel engages the support surface (e.g. floor) so that the height adjustable caster assembly becomes weight bearing. Under this condition, the user can more easily move the exercise machine. However, it is time-consuming and laborious to manually twist the screw to push the wheel to lift the exercise machine. Besides, the cost of using electric mechanisms such as motors to drive the wheel is higher.

Some commercial treadmills (such as the "INTEGRITY" series) produced by the American Life Fitness company can optionally be equipped with an adjustable wheel mechanism called "service wheel". When the staff needs to move the treadmill, they can move a handle on the left side of the rear end of the treadmill platform to the right along a transverse groove and then press it down into a recess, and a wheel at the bottom of the rear end of the treadmill platform is pushed downward and locked, so that the treadmill can use the wheel and the two ground wheels at the front to slide on the ground. After the treadmill is moved to the desired position, the handle must be raised upward from the recess and then moved back to the original position along the transverse groove to retract the wheel upward, that is, to allow the treadmill return to be supported on the ground by the two ground wheels at the front and two support feet at the rear. However, if the operator does not press the handle down to the recess to lock it after the handle is moved to the right end of the transverse groove (making the wheel contact the ground and the support feet are moved away from the ground, then, if the operator lets go of the handle, the weight of the treadmill will immediately cause the wheel to retract upward. At the same time, the handle will quickly return to the left along the transverse groove. The operating path of the aforementioned handle makes the operation slightly cumbersome.

On the other hands, patent CN209733154U discloses a massage chair. The massage chair has a mobility mechanism with caster brake structure disposed at the bottom of the massage chair, so that the rotation of casters can be controlled by pedaling. Thereby, the massage chair can be switched between a moving mode and a stabilizing mode. The aforementioned caster brake structure is commonly used in mobile cabinets and office furniture, which aids in the furniture's mobility. However, the caster brake structure may not be suitable for exercise apparatus, since it may not sustain the vibrations during exercise, which may cause it accidental unlocking.

The present invention has arisen to mitigate and/or obviate the disadvantages of exercise apparatuses. Further benefits and advantages of the present invention will become apparent after a careful reading of the detailed description with appropriate reference to the accompanying drawings.

SUMMARY OF THE INVENTION

The present invention is directed to a mobility mechanism for a kind of health equipment (such as exercise equipment of treadmills or stair climber, or massage equipment of massage chairs), which can switch between a stabilizing mode for resting on the ground and a mobile mode for sliding on the ground.

According to one aspect of the present invention, an exercise apparatus includes a frame and at least one height-adjustable wheel set. The frame has a plurality of support members mounted on a bottom of the frame. The frame is adapted to be rested on a floor surface via the support members. When the exercise apparatus is in use, at least one of the support members is unable to roll on the floor surface. Each height-adjustable wheel set has a swing seat, a wheel and a pushing member. The swing seat is pivotally mounted on the bottom of the frame about a first axis. The wheel is pivotally mounted on the swing seat and will move up or down with respect to the frame while the swing seat rotates about the first axis. The pushing member is movably mounted between the frame and the swing seat. When the pushing member is in a first position, the swing seat rotates to a first angle so that a bottom edge of the wheel is not lower than the support member that is unable to roll; and when the pushing member is in a second position, the swing seat rotates to a second angle so that the bottom edge of the wheel is lower than the support member that is unable to roll. The pushing member is operated to be movable between the first and second positions by rotating less than 360 degrees with respect to the frame around a second axis. When the pushing member is in the second position and pushes the swing seat directly or indirectly at the second angle, the height-adjustable wheel set is subjected to a reaction force from the floor surface due to the weight of the frame. The reaction force is applied to the swing seat in a direction corresponding to a rotational direction of the swing seat about the first axis from the second angle to the first angle. At the same time, the reaction force is applied to the pushing member in a direction corresponding to a rotational direction of the pushing member about the second axis from the first position to the second position.

Preferably, the swing seat is operable to rotate about the first axis to a third angle, the height of the wheel relative to the frame when the swing seat is in the third angle is lower than the height of the wheel relative to the frame when the swing seat is in the second angle. When the swing seat rotates from the first angle to the third angle, the bottom edge of the wheel does not pass under the first axis. When the pushing member rotates between the first and second positions, the pushing member will pass through a third position where the swing seat is directly or indirectly abutted by the pushing member at the third angle.

Preferably, the exercise apparatus further includes a linkage mechanism coupled to the pushing member of each height-adjustable wheel set. The linkage mechanism has an operating portion for being manually operated by a user. When the operating portion is located at an initial position, the pushing member is located at the first position. When the operating portion is located at an end position, the pushing member is located at the second position. When the operating portion is operated from the initial position to the end position, it will pass through an intermediate position where the pushing member is located at the third position.

Preferably, the pushing member has an arc-shaped abutting portion, and the center of the abutting portion is located apart from the second axis. The pushing member is kept in contact with the swing seat with the abutting portion, at least when the bottom edge of the wheel is lower than the support member that is unable to roll. The pushing member will contact the swing seat with different portions on an arc of the abutting portion as the pushing member rotates around the second axis.

Preferably, the linkage mechanism has at least one rotating member that matches the at least one height-adjustable wheel set, and each rotating member is pivotally mounted to the frame according to the corresponding second axis so that each rotating member is capable of being driven by movement of the operating portion to rotate around the corresponding second axis. The pushing member of each height-adjustable wheel set is circular, and its circumference forms the abutting portion, and the pushing member is pivotally mounted to the rotating member about a third axis that is parallel to the second axis.

Preferably, the exercise apparatus includes two of the height-adjustable wheel sets. The linkage mechanism has two of the rotating members and a connecting rod, and the two rotating members are rotatable about the respective second axes that are parallel to each other. The connecting rod has two ends respectively pivotally connected to parts of the two rotating members away from the respective second axes, so that the two rotating members can rotate synchronously.

Preferably, the linkage mechanism has an operating lever disposed at the bottom of the frame, which is operable to rotate about a vertical axis with respect to the frame. The longitudinal direction of the operating lever is perpendicular to the vertical axis, and one end of the operating lever is provided with the operating portion. The operating portion is operated to be moved between the initial position and the end position by rotating around the vertical axis. The initial position is located at right side or left side of the frame, and the end position is located at rear side of the frame.

Preferably, the operating lever is a telescopic rod that can be extended or shortened along its longitudinal axis. When the operating lever is shortened to a shortest length and the operating portion is located at the initial position, the entire operating lever is located within an outer edge of the bottom of the exercise apparatus. When the operating lever is extended to a longest length, the operating lever will remain outside the outer edge of the bottom of the exercise apparatus during the movement between the initial position and the end position.

Preferably, the operating lever is continuously acted upon by an elastic force, causing the operating lever to have a tendency to shorten to the shortest length.

Preferably, the frame has a first stop portion and a second stop portion. When the operating portion of the linkage mechanism is located at the initial position, the linkage mechanism partially abuts against the first stop portion. When the operating portion is located at the end position, the linkage mechanism partially abuts against the second stop portion, thereby limiting a movement range of the operating portion and a rotatable range of the pushing member.

Further benefits and advantages of the present invention will become apparent after a careful reading of the detailed description with appropriate reference to the accompanying drawings.

BRIEF DESCRIPTION OF DRAWINGS

FIG. 6 is a perspective view similar to FIG. 5 taken from another angle.

FIG. 7 is a top view of the rear portion of the treadmill, wherein the pushing member is in the retracted position.

FIG. 8 is a cross-sectional view along line A-A of FIG. 7.

FIG. 9 is a top view of the rear portion of the treadmill, wherein the pushing member is in the abutting position.

FIG. 10 is a cross-sectional view along line B-B of FIG. 9.

FIG. 11 is a top view of the rear portion of the treadmill, wherein the pushing member is in the temporary position.

FIG. 12 is a cross-sectional view along line C-C of FIG. 11.

DETAILED DESCRIPTION

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

Figure 1:
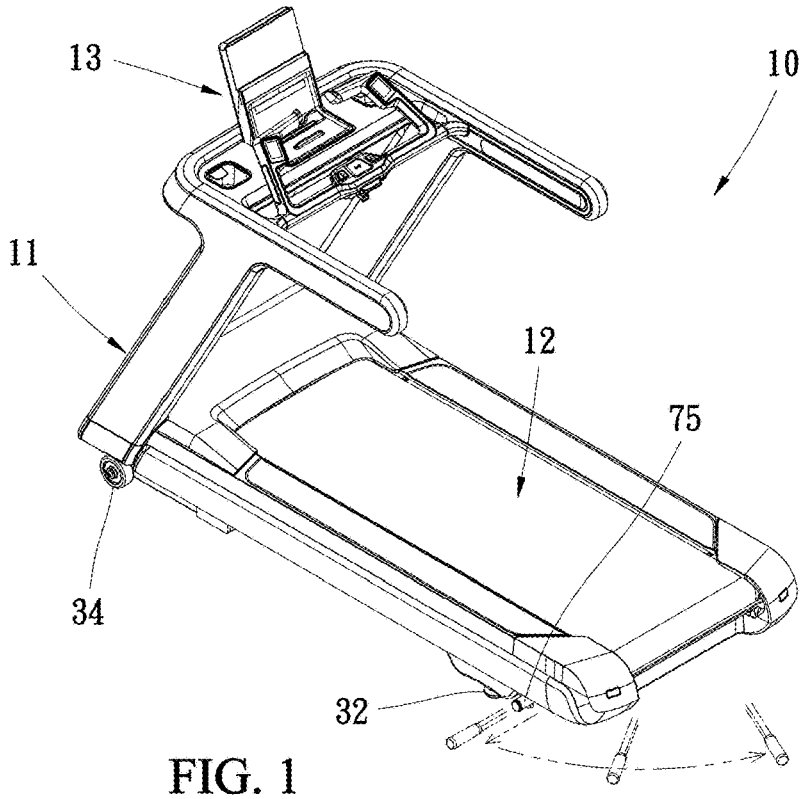
FIG. 1 is a perspective view of a health equipment (treadmill) in a stabilizing mode according to a first preferred embodiment of the present invention, wherein the phantom line illustrates the operation method of switching the treadmill into a mobile mode.
Figure 3:
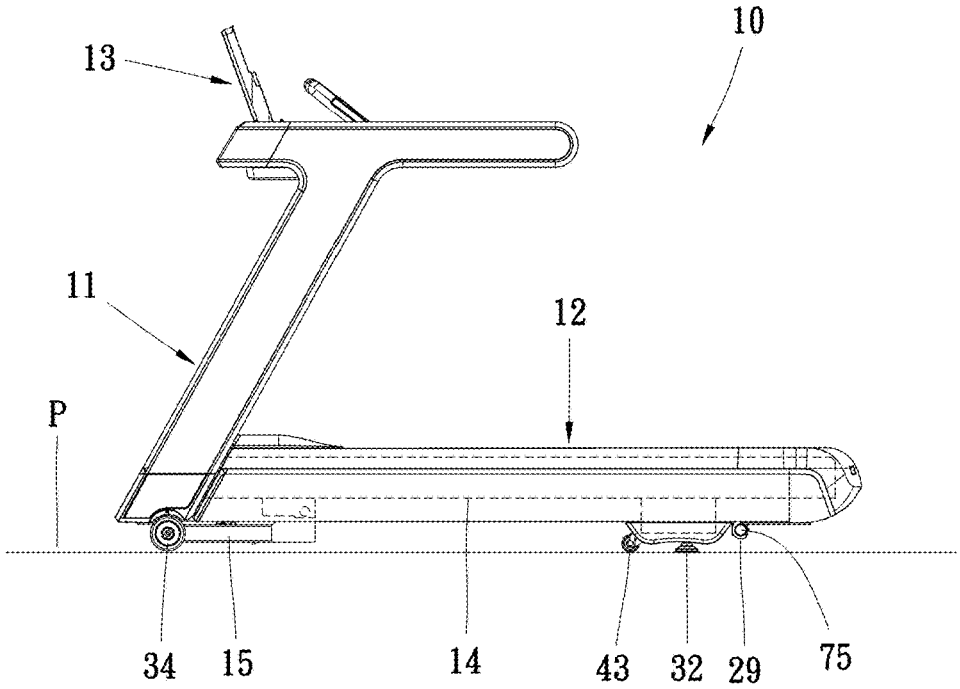
FIG. 3 is a side view of the treadmill in the stabilizing mode.

FIG. 1 illustrates a health equipment in accordance with a preferred embodiment of the present invention. Specifically, the health equipment is an exercise apparatus such as a treadmill 10. The treadmill 10 includes a frame 11, a treadmill platform 12 at the lower portion of the frame 11, and a console 13 at the upper portion of the frame 11. The frame 11 is a frame body structure of the treadmill 10 as the installation basis for the treadmill platform 12, the console and other mechanisms or devices. The treadmill 10 is adapted to be rested on a plane such as a ground or a floor surface, allowing a user to do exercises of walking, jogging or running on the treadmill platform 12. As shown in FIG. 3, in a normal use condition, namely when the treadmill 10 is in a stabilizing mode for human use, the frame 11 is supported by a plurality of support members located on the bottom of the frame 11 (including support feet 32 and caster wheels 34) on the plane P. Like a common treadmill structure nowadays, the bottom of the frame 11 mainly includes a main frame 14 of the treadmill platform 12 and a lifting frame 15 pivotally connected to the front end of the main frame 14. Two support feet 32 are disposed at the bottom of the rear end of the main frame 14, and two caster wheels 34 are disposed at the front (or bottom) end of the lifting frame 15. The frame 11 can be stably supported on the plane P through the two support feet 32 and the two caster wheels 34 (each forms an aforementioned support member) in a balanced arrangement. Even though the relative angle between the lifting frame 15 and the main frame 14 is changed (rise or lower the front end of the treadmill platform 12), the two support feet 32 and the two caster wheels 34 will still be supported on the plane P. In addition, since the bottoms of the two support feet 32 are disc-shaped foot pads that cannot roll (and slide) on the plan P, the treadmill 10 can be stabilized in the current position for use.

It should be noted that the aforementioned type of treadmill 10 and its frame 11 are provided for illustration purpose only. Of course, the present utility can also be applicable to other types of treadmills, and even to different types of exercise equipment or massage equipment, such as stair climber machines, massage chairs, and other health equipment, which can be placed on a plane for use. However, the exercise or the massage mechanism of the aforementioned health equipment is not covered in the present invention.

Figure 2:
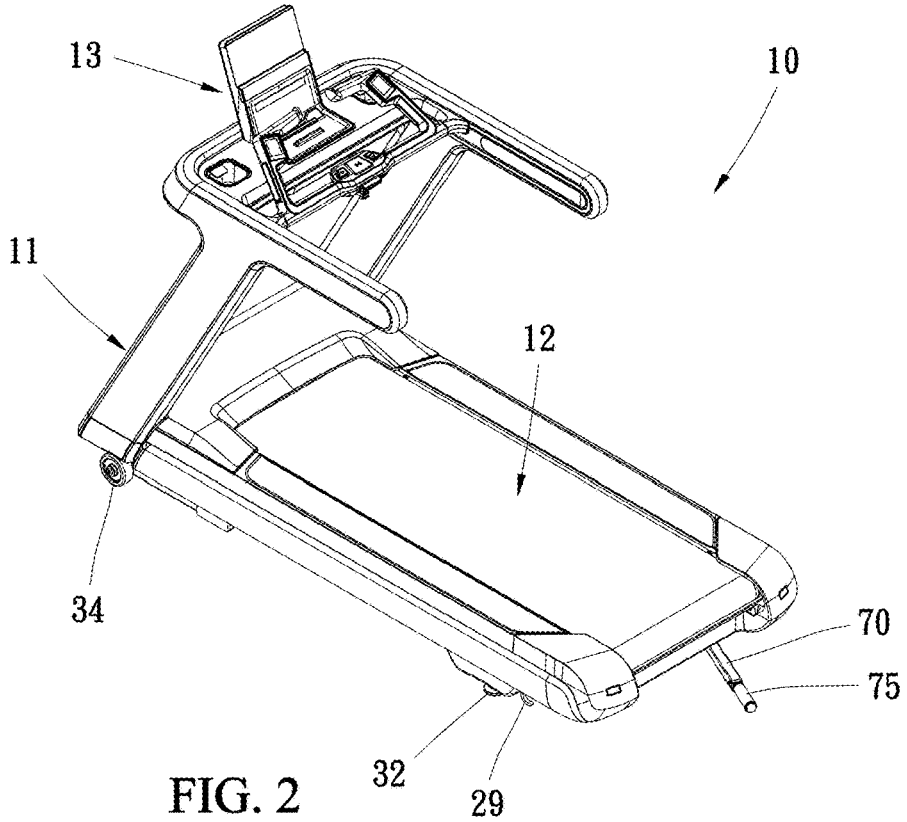
FIG. 2 is a perspective view of the treadmill in the mobile mode.
Figure 4:
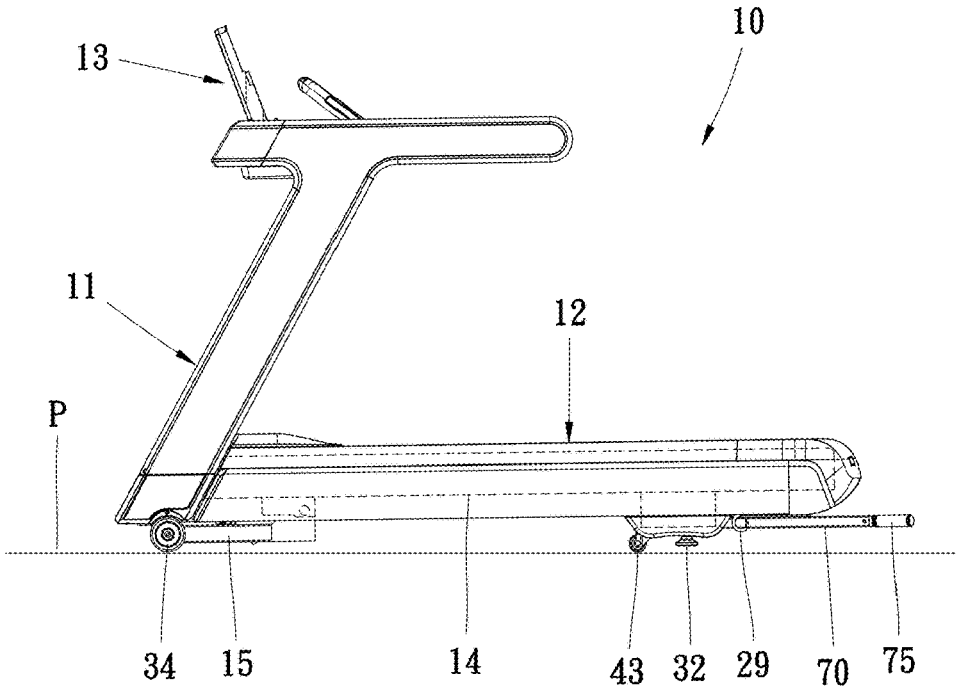
FIG. 4 is a side view of the treadmill in the mobile mode.

In the preferred embodiment of the present invention, when the treadmill 10 needs to be moved, the user can switch the treadmill 10 from a stabilizing mode shown in FIG. 1 and FIG. 3 to a mobile mode shown in FIG. 2 and FIG. 4. Briefly, two wheels 43 are added to the rear end of the main frame 14 to replace the two non-rolling support feet 32 and rest on the plane P, so that the frame 11 of the treadmill 10 is supported on the plane P through the two wheels 43 and the two caster wheels 34, and therefore the entire treadmill 10 can be pushed or pulled to slide directly on the plane P. As shown in FIG. 1, in the preferred embodiment, the treadmill 10 can be moved by pulling a handle 75 that is located on the left side of the rear end of the treadmill platform 12 toward the left and then turning it toward the rear right to the rear side of the treadmill platform 12, so that the treadmill 10 can be changed from the stabilizing mode to the mobile mode. On the contrary, moving the handle 75 from the rear side of the treadmill platform 12 return to the left side of the treadmill platform 12 can cause the two wheels 43 to retract upwards, so that the treadmill 10 can returned to the stabilizing mode from the mobile mode. The relevant structure and working principle of the aforementioned switching operation are explained below.

Figure 5:
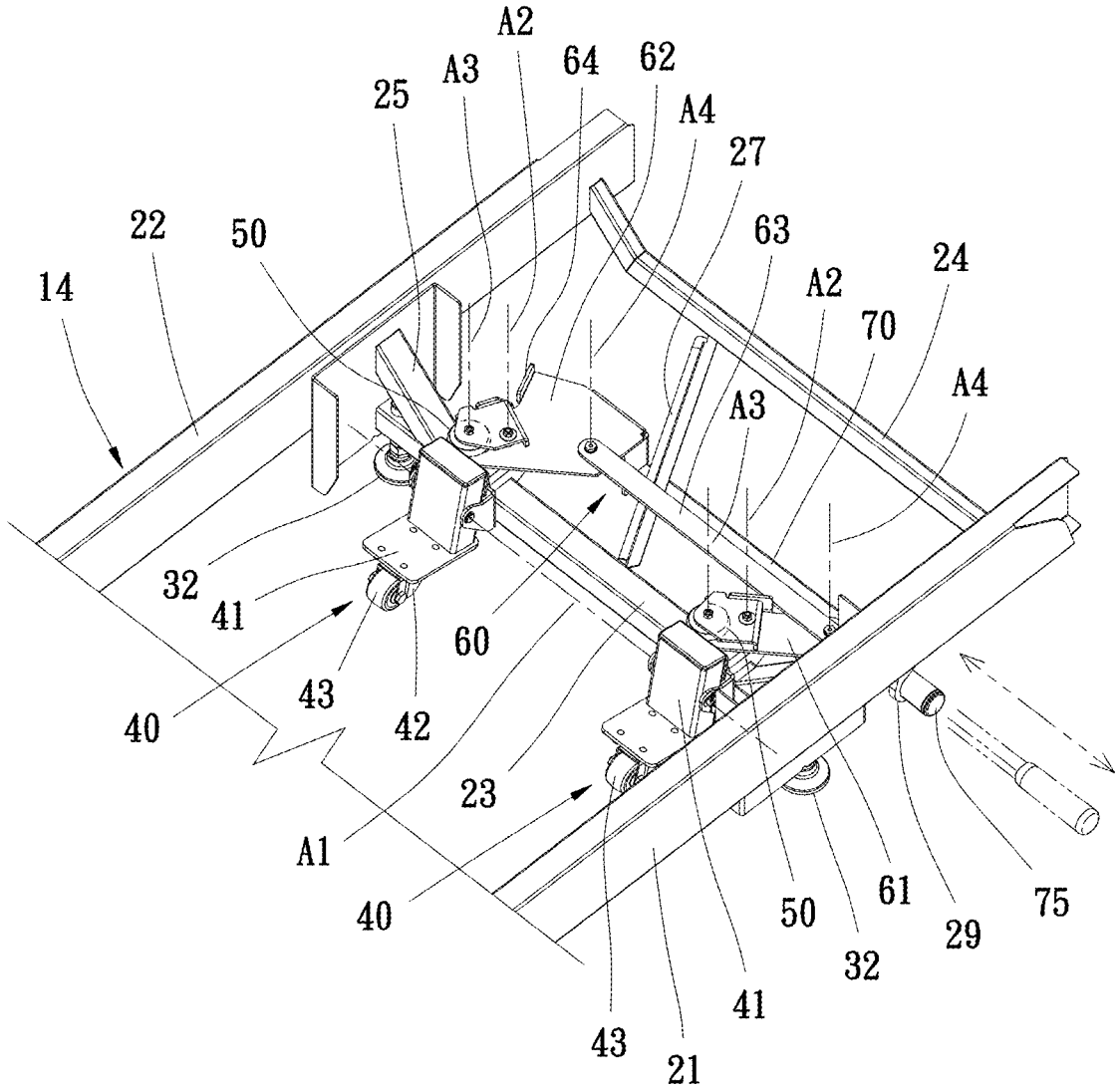
FIG. 5 is a perspective view of the rear portion of the treadmill in the stabilizing mode, wherein some parts of the treadmill are removed for observation
Figure 6:
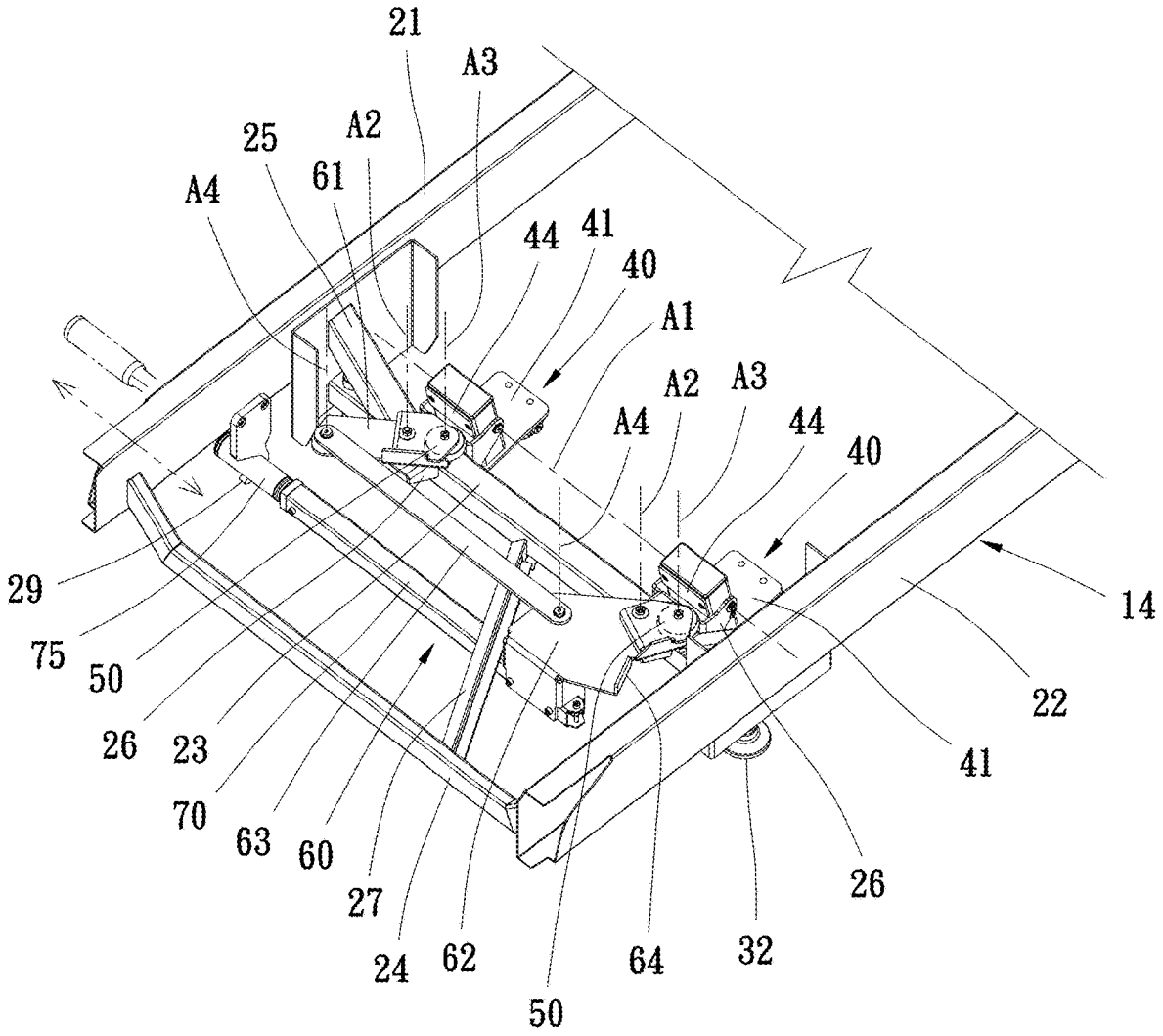
(FIG. 6 to FIG. 12 are the same).

FIG. 5 and FIG. 6 are perspective views of the rear portion of the treadmill platform 12 from two different angles (note: the running belt, treadmill deck, rollers and other components of the treadmill platform 12 are removed in the figures to facilitate observation of the important mechanism of the present embodiment; same as FIG. 7 to FIG. 12). The main frame 14 of the treadmill platform 12 has a left side post 21 and a right side post 22 that extend longitudinally and parallel to each other, and a first cross bar 23 and a second cross bar 24 are connected between the left side post 21 and the right side post 22. The first cross bar 23 is located in front of the second cross bar 24. As shown in FIG. 5 and FIG. 6, an oblique reinforcing rod 25 is fixed between the left end of the first cross bar 23 and the left side post 21; also, another oblique reinforcing rod 25 is fixed between the right end of the first cross bar 23 and the right side post 21. In addition, a bridging bar 27 extends rearward from the center of the first cross bar 23 to the second cross bar 24.

Referring to FIG. 6, two symmetrical left and right brackets 26 are fixed to the first cross bar 24. A swing seat 41 is pivotally connected to the front end of each bracket 26. The swing seat 41 can be rotatable with respect to the main frame 14 about a transverse first axis A1 within a limited range. In the preferred embodiment of the present invention, the first axis A1 corresponds to the lateral direction of the main frame 14, and the first axes A1 of the left and right swing seats 41 are collinear. The side view shows that each swing seat 41 is substantially L-shaped, with a vertical block part and a bottom plate part connected vertically to each other. The vertical block part of each swing seat 41 is located in front of the first cross bar 23, and the bottom plate part extends forward from the bottom end of the vertical block part. Each of the two brackets 26 is pivotally connected to the vertical block part of the swing seat 41 about the first axis A1, and the first axis A1 is located at the substantially middle height of the vertical block part. The rear side of each swing seat 41 (the vertical block part) is kept parallel to the first axis A1, and a wear-resistant sheet 44 made of, for example, PA6 material is attached to the upper portion of the rear side of the vertical block part of each swing seat 41. A caster seat 42 is pivotally mounted on the bottom of each swing seat 41 (i.e. at the bottom plate part). The caster seat 42 can rotate 360 degrees about a rotating shaft (now shown) with respect to the respective swing seat 41. The rotating shaft is vertical and perpendicular to the aforementioned first axis A1. Each of the aforementioned two wheels 43 is pivotally connected to the corresponding caster seat 42 about a wheel axle (not shown), and the wheel axle of each wheel 43 is perpendicular to the rotating shaft of the corresponding caster seat 42. Thereby, each wheel 43 can rotate about the wheel axle on the corresponding caster seat 42 and change direction relative to the corresponding swing seat 41 through the rotating shaft. For example, the orientation of each wheel 43 can be turned to a direction that the wheel axle corresponds to the lateral direction, or to a direction that the wheel axle corresponds to the longitudinal direction. In another embodiment, the wheel may be directly pivoted on the swing seat, so that the direction of the wheel axle is fixed, or the wheel may be spherical, with the upper part accommodated in a ball socket and capable of rolling in all directions. In any case, the wheel 43 will rise or fall relative to the main frame 14 as the swing seat 41 rotates around the first axis A1.

Figure 8:
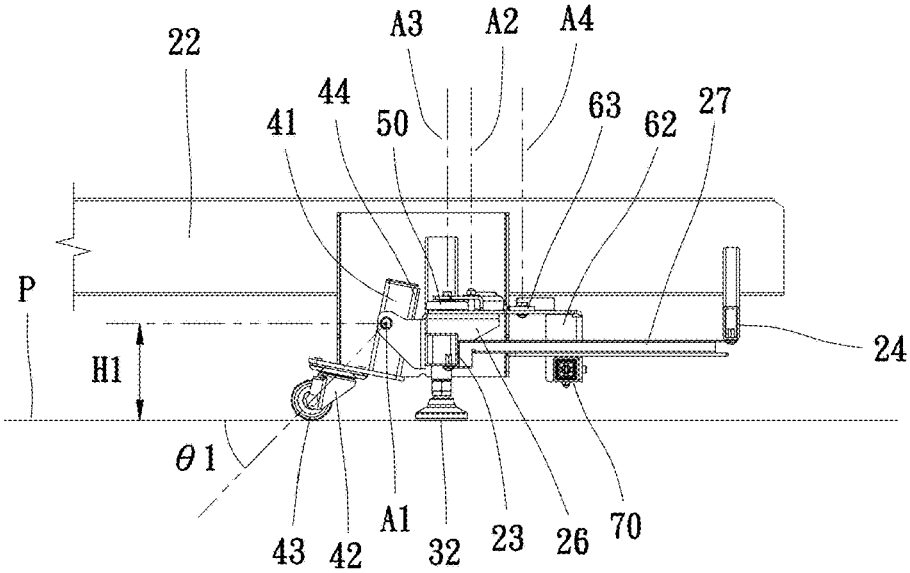
Figure 10:
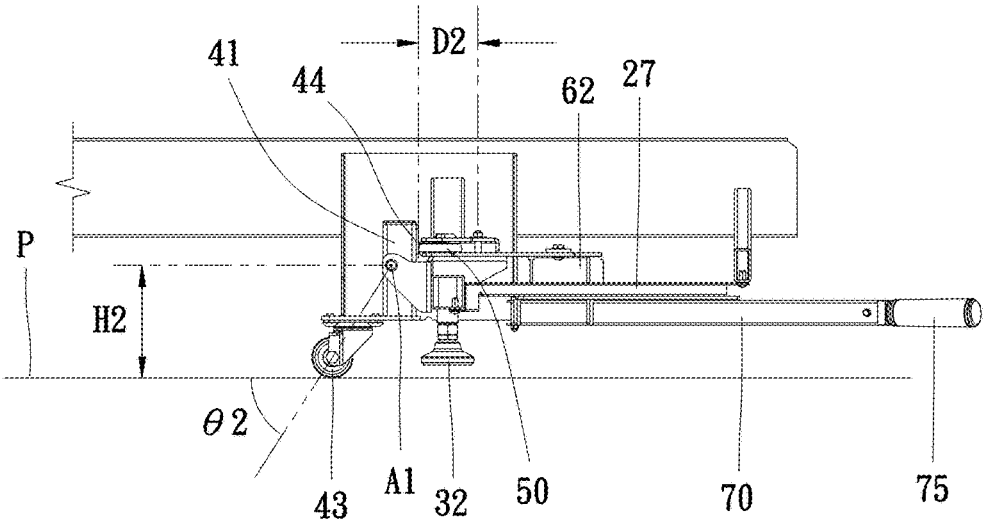

Behind the two swing seats 41, a left rotating member 61 and a right rotating member 62 are respectively pivotally connected to the two brackets 26 according to respective vertical second axes A2, which are parallel to each other. In the preferred embodiment, as shown in FIG. 6 and FIG. 8, each second axis A2 is perpendicular to the first axis A1 (not in the same plane). When the top surface of the treadmill platform 12 is parallel to the plane P (as shown in FIG. 3), the two second axes A2 are exactly perpendicular to the plane P. Each of the left rotating member 61 and the right rotating member 62 is coupled with a pushing member 50. The pushing member 50 has a shape similar to a round wheel. The pushing member 50 is pivotally mounted on the corresponding rotating member 61/62 according to a third axis A3 that is parallel to the second axis A2. Thereby, each pushing member 50 can not only rotate around the second axis A2 with the rotation of the corresponding rotating member 61/62 with respect to the main frame 14, but can also rotate about the third axis A3 on the corresponding rotating member 61/62. As shown in FIG. 8 and FIG. 10, each pushing member 50 is located higher than the first axis A1, or at least a portion located at the rear side of the upper portion of the corresponding swing seat 41 is higher than the first axis A1. The circumference of each pushing member 50 forms an abutting portion configured for abutting against the backside of the upper portion of the corresponding swing seat 41 (namely the portion where the wear-resistant sheet 44 is provided). The swing seat 41, the caster seat 42, the wheel 43, and the pushing member 50 on the same side constitute a height-adjustable wheel set 40. In other words, there are two height-adjustable wheel sets 40 in the present embodiment.

There is a connecting rod 63 connected between the left rotating member 61 and the right rotating member 62. The left and right ends of the connecting rod 63 are respectively pivotally connected to parts of the left rotating member 61 and the right rotating member 62 according to respective fourth axes A4 away from the respective second axes A2. The two fourth axes A4 and the two second axes A2 are parallel to one another, and their positions together form a parallelogram (as shown in FIG. 7), so that the left rotating member 61 and the right rotating member 62 can rotate synchronously relative to the main frame 14, making them similar to two rock arms in a parallel four-bar linkage mechanism.

Figure 7:
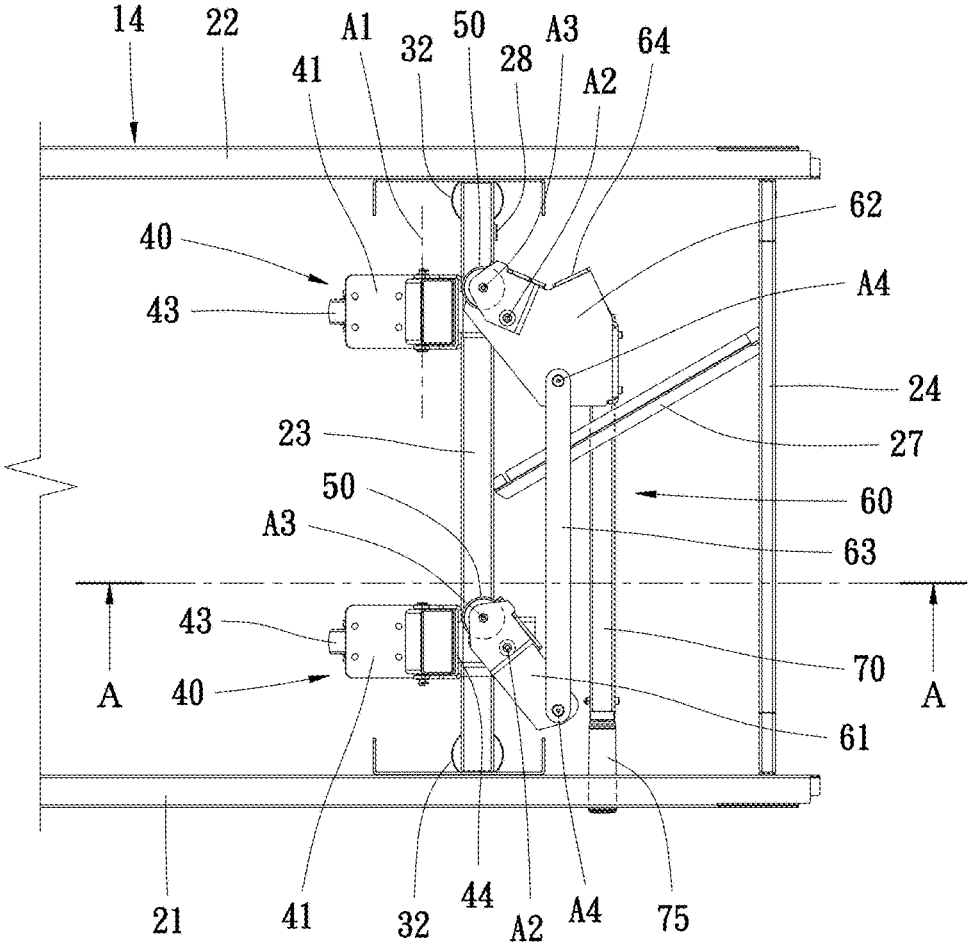

As shown in FIG. 7, an operating lever 70 has one end (inner end) fixed to the right rotating member 62 so that the operating lever 70 can rotate around the second axis A2 of the right rotating member 62 (hereinafter, referred to as right-side second axis) with respect to the main frame 14, and rotation of the operating lever 70 drives the left rotating member 61 and the right rotating member 62 to rotate synchronously. The longitudinal direction of the operating lever 70 is perpendicular to the aforementioned right-side second axis A2, so it is general for the operating lever 70 to rotate laterally on a horizontal plane. Within the rotatable range of the operating lever 70, the top surface of the operating lever 70 is kept partially abutting against the bottom surface of the bridging bar 27, and a wear-resistant sheet (not shown) made of, for example, PA6 material is attached to the bottom surface of the bridging bar 27. The aforementioned handle 75 is disposed at the other end (outer end) of the operating lever 70. Therefore, turning the handle 75 is actually turning the operating lever 70.

The left rotating member 61, the right rotating member 62, the connecting rod 63, and the operating lever 70 (including the handle 75) constitute a linkage mechanism 60. The linkage mechanism 60 is coupled to the pushing members 50 of the two height-adjustable wheel sets 40. The handle 75 at the outer end of the operating lever 70 forms an operating portion of the linkage mechanism 60 for being manually operated by the user to control the movement of the operating lever 70 between an initial position and an end position. In the preferred embodiment of the present invention, when the handle 75 is in the initial position, the treadmill 10 is in the aforementioned stabilizing mode; when the handle 75 is in the end position, the treadmill 10 is in the aforementioned mobile mode.

Figure 14:
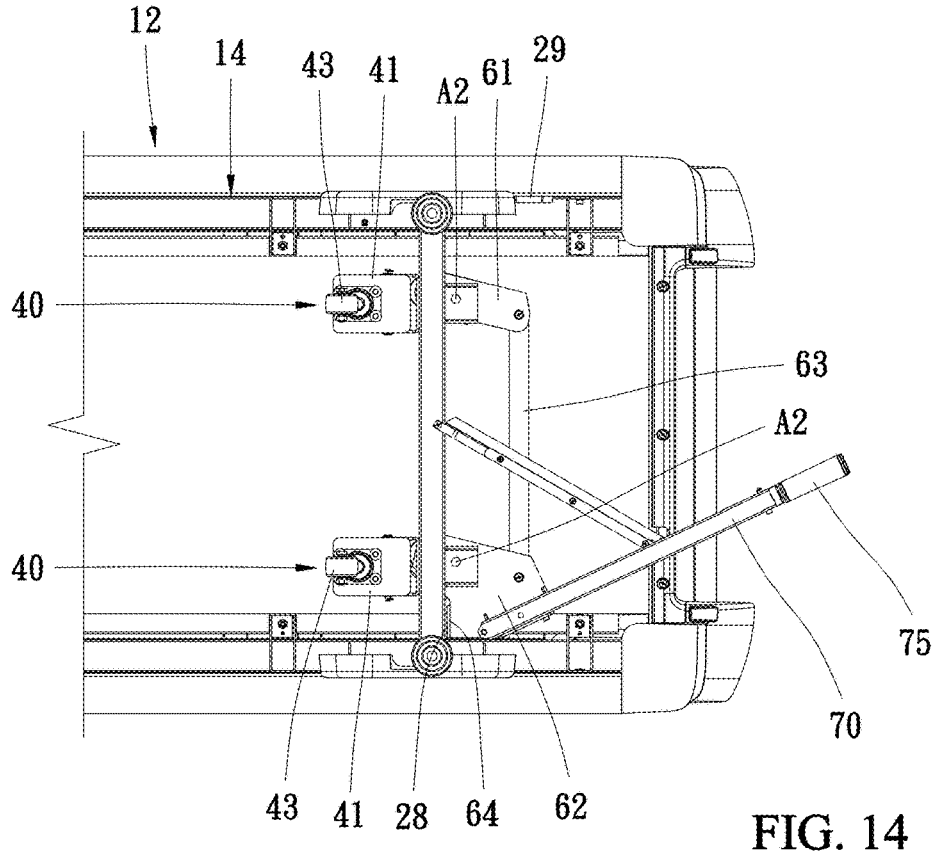
FIG. 14 is a bottom view of the rear portion of the treadmill in the mobile mode.

Referring to FIGS. 5, 6, 7 and FIG. 13, under normal conditions, the handle 75 is situated on the left side of the rear end of the treadmill platform 12, and it can be secured in a positioning hook 29 with a designated rear opening. The positioning hook 29 forms a start-point retaining portion to prevent the handle 75 and the operating lever 70 from rotating forward around the right-side second axis A2 from this position (that is, rotating in a clockwise direction, referred to as reverse direction hereinafter). At this time, the orientation of the handle 75 relative to the right-side second axis A2 is defined as the aforementioned initial position. When the user forces the handle 75 and the operating lever 70 to rotate toward the right rear around the right-side second axis A2 (that is, rotating in a counterclockwise direction, referred to as forward direction hereinafter), the left rotating member 61 and the right rotating member 62 will be driven to rotate synchronously. At the same time, both the pushing members 50 mounted on the left rotating member 61 and the right rotating member 62 will also rotate around their respective second axes A2 in the forward direction until reaching the state shown in FIG. 9 and FIG. 14. That is, a stop portion 64 of the right rotating member 62 abuts against a rubber pad 28 attached to the oblique reinforcing rod 25 at the right end of the first cross bar 23. The rubber pad 28 forms an end-point retaining portion to indirectly prevent the handle 75 and the operating lever 70 from rotating forward around the right-side second axis A2 in the forward direction from this position. At this time, the orientation of the handle 75 relative to the right-side second axis A2 is defined as the aforementioned end position. In the preferred embodiment of the present invention, the difference between the initial position and the end position is 65 degrees. Therefore, the rotation range of each pushing member 50 around the corresponding second axis A2 is also 65 degrees.

Referring to FIG. 7 and FIG. 8, in the aforementioned stabilizing mode, the support feet 32 at the bottom of the rear end of the main frame 14 are supported on the plane P, so that the treadmill 10 cannot be moved on the plane P. In the normal use condition, the handle 75 is positioned at the aforementioned initial position on the left side of the rear end of the treadmill platform 12. Due to the restraint offered by the linkage mechanism 60, each of the pushing members 50 is situated in a retracted position that is somewhat backward and it will not interfere with the forward swing seat 41, so that the wheel 43 at the front end of each swing seat 41 can be naturally rested on the plane P. At the same time, there is still an appropriate distance between the backside of each swing seat 41 and the corresponding pushing member 50. In this state, as shown in FIG. 8, the front end of the bottom of each swing seat 41 (i.e. the bottom plate part) is higher than the rear end, so that the aforementioned rotating shaft of the caster seat 42 with respect to the respective swing seat 41 slants backward, that is, the upper end of the rotating shaft slants to the rear. Therefore, the wheel 43 that can change direction relative to the corresponding swing seat 41 around the rotating shaft will naturally turn to the frontmost position (i.e. the highest position), and the wheel axle corresponds to the lateral direction. Specifically, the angle of the swing seat 41 relative to the main frame 14 is represented by an angle of depression of the wheel axle of the wheel 43 at the frontmost position relative to the first axis A1 as shown in FIG. 8, which is defined as a first angle θ1 at this time (the actual value is about 46 degrees). In addition, the height of the first axis A1 from the plane P is also marked in FIG. 8, which is defined as a first height H1 at this time. The aforementioned height is positively correlated with the aforementioned angle of depression, that is, the higher the height, the lower the wheel 43 with respect to the main frame 14.

Figure 9:
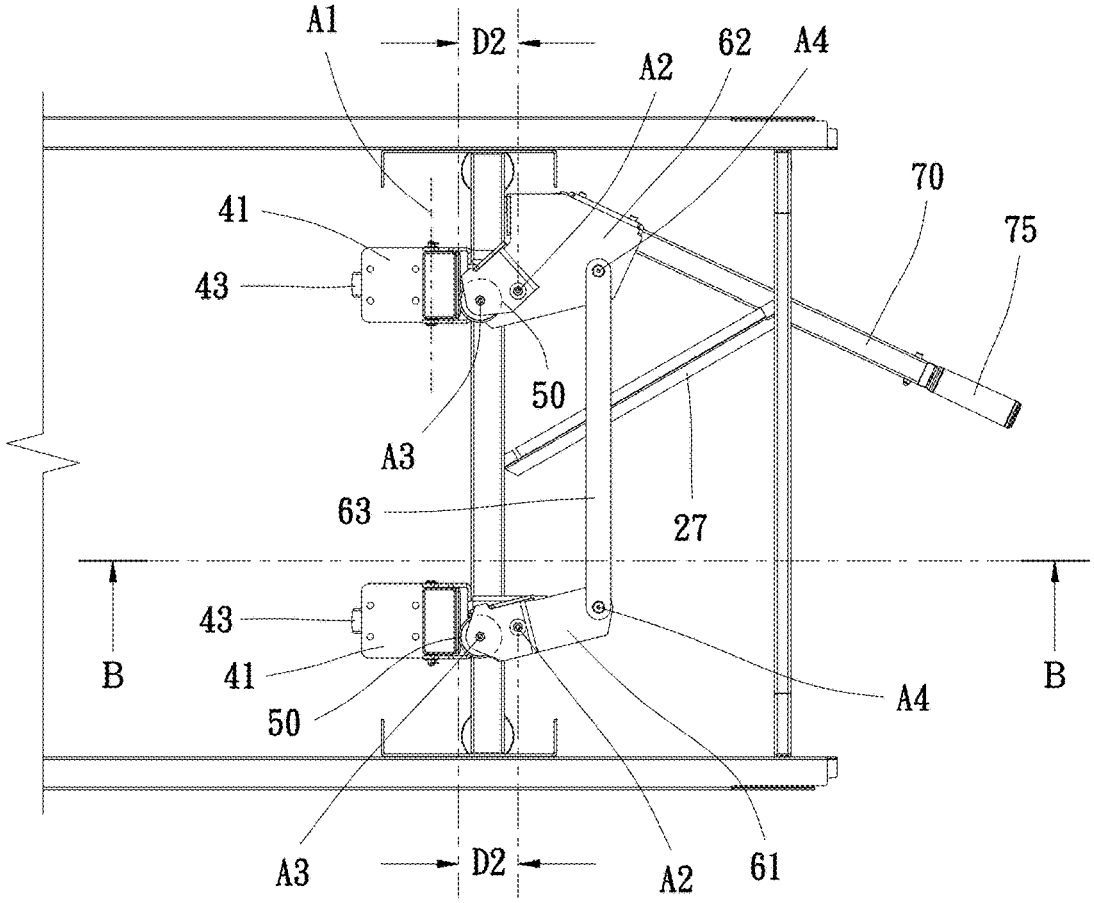

When the handle 75 is rotated 65 degrees in the forward direction from the initial position shown in FIG. 7 to the end position shown in FIG. 9, based on the linkage of the aforementioned linkage mechanism 60, each of the pushing members 50 will also be rotated 65 degrees around the second axis A2 in the forward direction from the retracted position shown in FIG. 7 to an abutting position that is somewhat forward shown in FIG. 9, so that the front end of the circumference of each pushing member 50 (i.e. the aforementioned abutting portion) abuts against the backside of the upper portion of the corresponding swing seat 41. Therefore, the swing seat 41 is pushed to a second angle θ2 as shown in FIG. 10 (the actual value is about 57 degrees, which is greater than the first angle θ1), so that the height of the wheel 43 relative to the main frame 14 is changed from a height where the bottom edge of the wheel 43 is level with the bottom of the support foot 32 to a height where the wheel 43 is lower than the support foot 32. In other words, at this time, the two wheels 43 will sustain the weight above against the plane P, while the support feet 32 are lifted away from the plane P. That is, the main frame 14 is supported by the two wheels 43 that are slightly lower, just like the second height H2 shown in FIG. 10 is higher than the first height H1 shown in FIG. 8.

Figure 11:
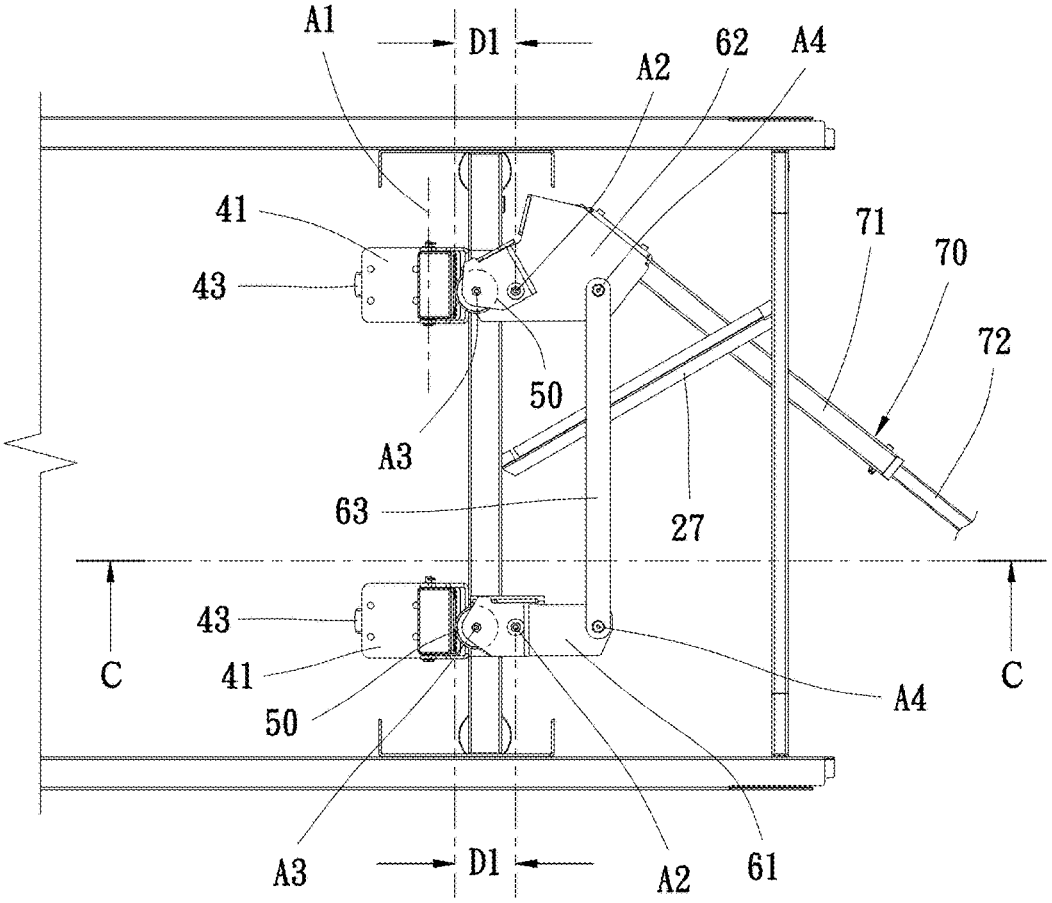
Figure 12:
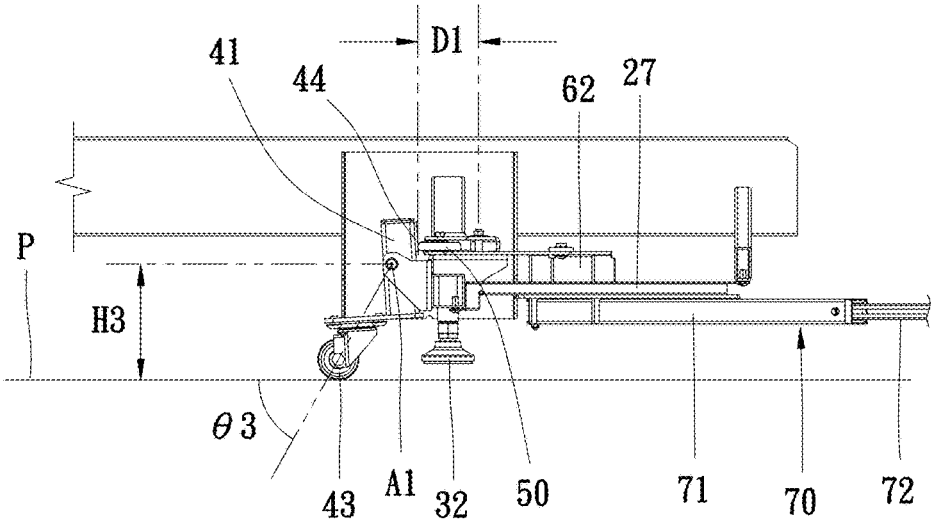
Figure 13:
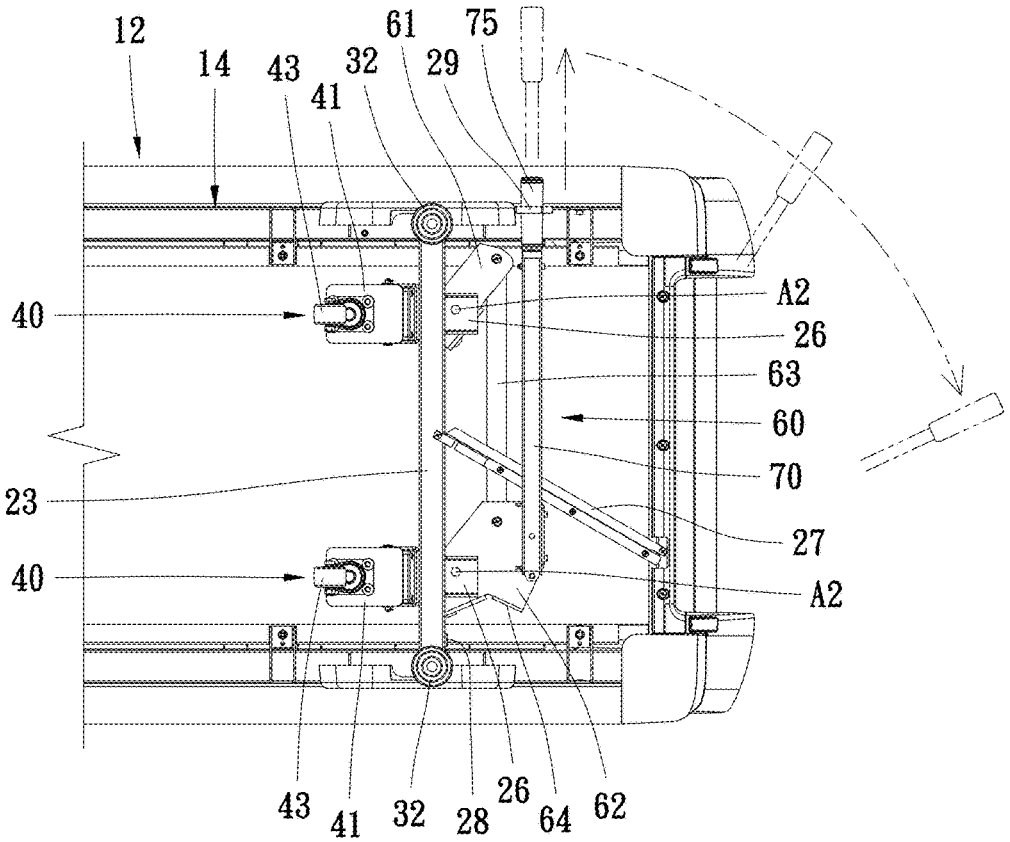
FIG. 13 is a bottom view of the rear portion of the treadmill in the stabilizing mode, wherein the phantom line illustrates the operation method of switching the treadmill into a mobile mode.

When the handle 75 is operated to rotate from the initial position to the end position, the handle 95 will pass through an intermediate position as shown in FIG. 11 (note: the handle 75 is not shown in FIG. 11, but its position with respect to the second axis A2 can be determined by the longitudinal direction of the operating lever 70). In the preferred embodiment of the present invention, the difference between the intermediate position and the initial position is approximately 51 degrees, and the difference between the intermediate position and the end position is approximately 14 degrees. When the handle 75 is located at the intermediate position, based on the linkage of the linkage mechanism 60, each of the pushing members 50 is correspondingly positioned at a temporary position between the retracted position and the abutting position. At this time, the frontmost end of the circumference of each pushing member 50 abuts against the backside of the upper portion of the corresponding swing seat 41, thereby pushing the swing seat 41 to a third angle θ3 as shown in FIG. 12 (the actual value is about 61 degrees, which is greater than the second angle θ2). When the swing seat 41 is located at the third angle θ3, the height of the wheel 43 relative to the main frame 14 is lower than the relative height of the wheel 43 when the swing seat 41 is located at the second angle θ2. Besides, when the swing seat 41 rotates from the first angle θ1 to the third angle θ3, the bottom edge of the wheel 43 does not pass under the first axis A1. The third angle θ3 is greater than the second angle θ2. As shown in FIG. 11, when the pushing member 50 is located at the temporary position, the center of the pushing member 50 is located directly in front of the corresponding second axis A2. In other words, the pushing member 50 is located at the frontmost position in its rotatable range, and the distance between the frontmost end of the circumference of the pushing member 50 and the second axis A2 is defined as a first distance D1; In contrast, as shown in FIG. 9, when the pushing member 50 crosses the temporary position to the abutting position, the center of the pushing member 50 located at the left front of the corresponding second axis A2 (to be precise, it is about 14 degrees to the left of the front), and the distance between the frontmost end of the circumference of the pushing member 50 and the second axis A2 is defined as a second distance D2. The second distance D2 is slightly smaller than the first distance D1.

That is to say, when the handle 75 is operated to rotate from the initial position to the end position and the two pushing members 50 are simultaneously rotated from the retracted position to the abutting position, each pushing member 50 actually moves forward for a longer distance, then moves backward for a shorter distance. Therefore, the aforementioned swing seat 41 pushed forward by the respective pushing member 50 will rotate about 15 degrees in a counterclockwise direction (hereinafter, referred to as wheel lowering direction) from the first angle θ1 as shown in FIG. 8 to the third angle θ3 as shown in FIG. 12 first (it will pass through the second angle θ2 on the way), and then the swing seat 41 will rotate about 4 degrees in an opposite direction ((hereinafter, referred to as wheel raising direction)) and return to the second angle θ2 as shown in FIG. 10 from the third angle θ3. Correspondingly, the height of the wheel 43 with respect to the main frame 14 will be lowered from the height shown in FIG. 8 to the height shown in FIG. 12, and then slightly raised from the height shown in FIG. 12 to the height shown in FIG. 10, just like the third height H3 shown in FIG. 12 is slightly higher than the second height H2 shown in FIG. 10.

Referring to FIG. 10, when the pushing member 50 is in the abutting position to push the swing seat 41 at the second angle θ2 so that the bottom edge of the wheel 43 is lower than the support foot 32 against the plane P, the height-adjustable wheel set 40 is subject to a reaction force from the plane P due to the weight of the main frame 14 (including the weight of the main frame 14 and the weight sustained by the main frame 14). The direction of the reaction force applied to the swing seat 41 corresponds to the rotational direction of the swing seat 41 around the first axis A1 from the second angle θ2 to the first angle θ1 (namely the wheel raising direction, corresponding to the clockwise direction shown in FIG. 10); at the same time, the direction of the reaction force applied to the pushing member 50 corresponds to the rotational direction of the pushing member 50 around the second axis A2 from the retracted position to the abutting position (namely the forward direction, corresponding to the counterclockwise direction shown in FIG. 9).

In short, in the preferred embodiment of the present invention, since the upper portion of the swing seat 41 is pushed forward by the pushing member 50, the wheel 43 is forced to swing downward to raise the main frame 14 (namely, making the main frame 14 move upward away from the plane P). The weight of the main frame 14 (that is, the force that wants to force the main frame 14 relatively close to the plane P along the direction of gravity) is intended to cause the wheel 43 to swing upward and the upper end of the swing seat 41 to swing backward, thereby pushing the pushing member 50 backward. However, as mentioned above, when the pushing member 50 is in the abutting position, the center of the pushing member 50 is located at the left front of the corresponding second axis A2, and is restrained by the displaceable range of the linkage mechanism 60, so that it can no longer rotate in the forward direction. Thereby, the aforementioned reaction force exerts a force on the pushing member 50 through the swing seat 41, which not only prevents the pushing member 50 from rotating in the forward direction (that is, to rotate toward the left rear around the second axis A2), but also forms a resistance that hinders the rotation of the pushing member 50 in the reverse direction (that is, to rotate toward the right front around the second axis A2). Therefore, the pushing member 50 that is subjected to the reaction force will be positioned at the abutting position, and the swing seat 41 will also be positioned at the second angle θ2, and not swing toward the first angle θ1. In general, after the user rotates the handle 75 to the end position, the linkage mechanism 60 and the two height-adjustable wheel sets 40 will be stable in the state shown in FIG. 9 and FIG. 10 and will not return to the state shown in FIG. 7 and FIG. 8, even if the user releases the handle 75.

In the state shown in FIG. 10, the two wheels 43 bear the weight above it and are in contact with the plane P, and the two support feet 32 are suspended away from the plane P, so that the frame 11 of the treadmill 10 is supported on the plane P through the two wheels 43 and the two caster wheels 34, as shown in FIG. 4. Therefore, the entire treadmill 10 can be pushed or pulled to slide on the plane P, turning it into the mobile mode mentioned above. Specifically, when the swing seat 41 is located at the second angle θ2 with respect to the main frame 14, the bottom surface of the swing seat 41 is exactly parallel to the plane P, that is, the rotating shaft of the caster seat 42 with respect to the respective swing seat 41 is perpendicular to the plane P, so that the wheel axle of each wheel 43 can automatically change direction in accordance with the direction in which the treadmill 10 is pushed or dragged, making the movement smooth and labor-saving.

After the treadmill 10 is pushed or pulled to the desired position, especially before it is used by people, the treadmill 10 has to be switched from the mobile mode back to the stabilizing mode. The operating method is like the reverse action of switching from the stabilizing mode to the mobile mode, that is, rotating the handle 75 from the end position back to the initial position along the reverse direction. Corresponding to the rotation of the handle 75 from the end position through the intermediate position to the initial position, the two pushing members 50 will rotate simultaneously from the abutting position through the temporary position to the retracted position. At the stage where each pushing member 50 rotates from the abutting position shown in FIG. 9 to the temporary position shown in FIG. 11, since each pushing member 50 is moved toward the right front around the second axis A2, the corresponding swing seat 41 will swing from the second angle θ2 shown in FIG. 10 to the third angle θ3 shown in FIG. 12 along the wheel lowering direction, so that the corresponding wheel 43 is slightly lowered relative to the main frame 14, namely the main frame 14 is slightly raised relative to the plane P; then, at the stage where each pushing member 50 rotates from the temporary position shown in FIG. 11 to the retracted position shown in FIG. 7, since each pushing member 50 is moved toward the right rear around the second axis A2, the corresponding swing seat 41 will swing from the third angle θ3 shown in FIG. 12 to the first angle θ1 shown in FIG. 8 along the wheel raising direction, so that the corresponding wheel 43 is raised from the lowermost position to the highermost position relative to the main frame 14. That is, the main frame 14 is lowered from the highest height to the lowest height relative to the plane P, returning to the state where the two support feet 32 are supported against the plane P and the two wheels 43 are naturally laid on the plane P.

At the beginning of the process of switching the treadmill 10 from the mobile mode to the stabilizing mode, since the reaction force generated by the weight of the main frame 14 hinders the rotation of each pushing member 50 from the abutting position in the reverse direction, namely hindering rotation of the handle 75 from the end position in the reverse direction, the user has to pull the handle 75 to the left with sufficient force to overcome the reaction force. After the handle 75 has passed the intermediate position, namely each pushing member 50 has passed the temporary position, the weight of the main frame 14 turns to assist each pushing member 50 and the handle 75 in rotating in the reverse direction until the two swing seats 41 move back to the first angle θ1, that is, the two support feet 32 fall back to the plane P (note: before that, the two wheels 43 will naturally turn to the frontmost position). Afterward, the user continues to move the handle 75 to the initial position, so that it can be secured in the positioning hook 29 on the left side of the rear end of the treadmill platform 12, which prevents it from shaking due to vibration during use.

Figure 15:
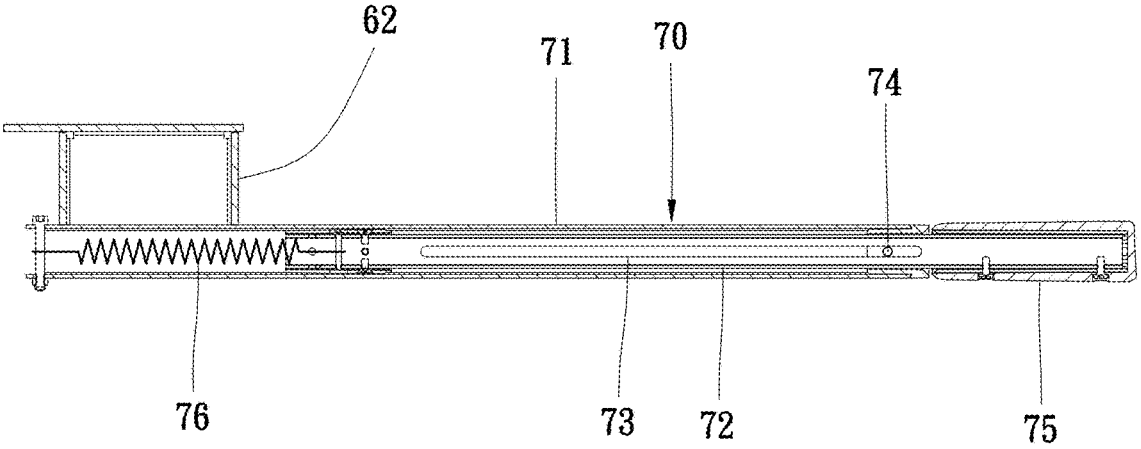
FIG. 15 is a cross-sectional view of the operating lever in accordance with the preferred embodiment of the present invention.
Figure 16:
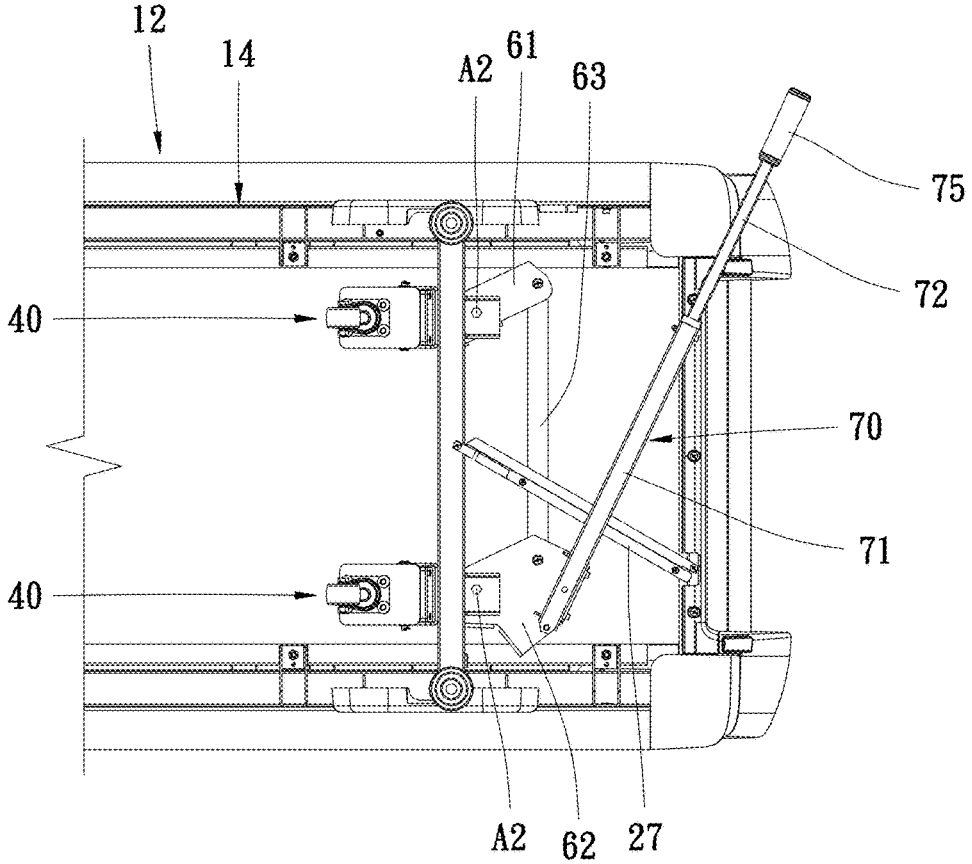
FIG. 16 is a bottom view of the rear portion of the treadmill in a transitional state between the stabilizing mode and the mobile mode.

Referring to FIG. 15, in the preferred embodiment of the present invention, the operating lever 70 is a telescopic rod that can be extended or shortened along its longitudinal direction, including an outer tube 71 and an inner tube 72. One end of the outer tube 71 (namely the inner end of the operating lever 70) is fixed to the right rotating member 62. The inner tube 72 is slidably inserted into the interior of the outer tube 71, and one end of the inner tube 72 (namely the outer end of the operating lever 70) is kept outside the outer tube 71 and is provided with the handle 75, so that the handle 75 can approach or move away from the outer tube 71 along with the inner tube 72. The inner tube 72 has two guide slots 73 that extend longitudinally on two opposite sides of the wall of the inner tube 72. A guide pin 74 is fixed inside the outer tube 71 and passes through the two guide slots 73 of the inner tube 72 so as to limit the sliding range of the inner tube 72 with respect to the outer tube 71. In addition, a tension spring 76 is connected between the outer tube 71 and the inner tube 72, and an elastic force exerted by the tension spring 76 corresponds to the longitudinal direction that pulls the inner tube 72 closer to the outer tube 71, causing the operating lever 70 to have a tendency to shorten to the shortest length (as shown in FIG. 15). Therefore, as shown in the solid line part of FIG. 13, when the handle 75 is located at the initial position on the left side of the rear end of the treadmill platform 12, it can retract inward until it locked by the positioning hook 29, and the outer end of the handle 75 does not exceed the left outer edge of the treadmill platform 12, so that the entire operating lever 70 is located within the outer edge of the treadmill platform 12 and concealed under the bottom of the treadmill platform 12. Based on the telescopic ability of the operating lever 70, when the user wants to move the handle 75 from the initial position on the left side of the treadmill platform 12 to the end position on the rear side of the treadmill platform 12, the user generally pulls the handle 75 out beyond the left outer edge of the treadmill platform 12 first, makes the operating lever 70 extend to the longest length or appropriate length, and then rotates the handle 75 to the right rear, as depicted by the phantom line in FIG. 1 and FIG. 13. If the user lets go of the handle 75 when it reaches the end position, the operating lever 70 will automatically shorten to the state shown in FIG. 2 and FIG. 14. Similarly, when the user wants to move the handle 75 from the end position back to the initial position, they generally pull the handle 75 out to lengthen the operating lever 70 first, then start to rotate it. As shown in FIG. 16, when the operating lever 70 is extended to the longest length, the handle 75 can protrude outside the left rear corner of the treadmill platform 12. This means that when the operating lever 70 is extended to its longest state, the handle 75 will remain outside the outer edge of the treadmill platform 12 during the movement process between the initial position and the end position, which will make the rotating operation easier. In other embodiments, there is no elastic force between the outer tube and the inner tube, so that the user is able to lengthen or shorten the length of the operating lever according to the situation.

In the above structure, since the distance from the handle 75 to the right-side second axis A2 (similar to the effort arm in a lever mechanism) is significantly longer than the distance from the circumference of each pushing member 50 to the corresponding second axis A2 (similar to the resistant arm), it is labor-saving for the user to rotate the operating lever 70 to push the wheels 43 downward.

Furthermore, in the preferred embodiment of the present invention, each pushing member 50 is shaped like a round wheel, and the center of which is located apart from the corresponding second axis A2 that the corresponding rotating member 61/62 rotates around. Each pushing member 50 is kept in contact with the backside of the corresponding swing seat 41, with the front end of its circumference (i.e. the aforementioned abutting portion), at least when the bottom edge of each wheel 43 is lower than the corresponding support foot 32. Besides, when each pushing member 50 rotates around the corresponding second axis A2, the pushing member 50 will revolve about its center (i.e. the third axis A3) on the corresponding rotating member 61/62, so that the pushing member 50 can contact the corresponding swing seat 41 with different portions on the arc of the abutting portion. It is like rolling the backside of the corresponding swing seat 41 with the circumference of the pushing member 50, thereby reducing friction resistance and noise, making the operation smooth.

Figure 17:
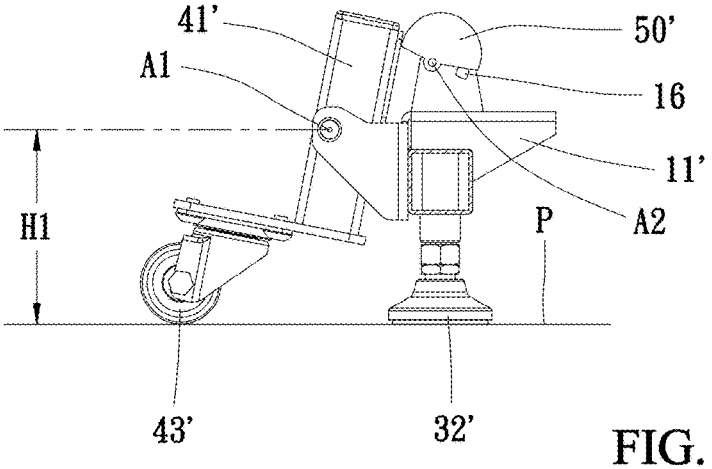
FIGS. 17 to 19 are side views of the height-adjustable wheel set in accordance with a second preferred embodiment of the present invention, showing the pushing member in the retracted position, temporary position, and abutting position in sequence.

FIG. 17 is a side view of another height-adjustable wheel set in accordance with a second preferred embodiment of the present invention. The height-adjustable wheel set mainly includes a swing seat 41', a wheel 43' and a pushing member 50'. The structures of the swing seat 41' and the wheel 43' are the same as those of the previous embodiment. The pushing member 50' is pivotally mounted on the bottom of the frame 11' of the health equipment according to a transverse second axis A2. The pushing member 50' is relatively located behind the upper portion of the swing seat 41', which is rotatable around the second axis A2 between a retracted position shown in FIG. 17 and an abutting position shown in FIG. 19. The frame 11' is provided with a stopper 16 that directly restricts the rotation of the pushing member 50', so that the pushing member 50' can only rotate to the abutting position in a forward direction (corresponding to the counterclockwise direction in the figure) and rotate to the retracted position in a reverse direction (corresponding to the clockwise direction in the figure). The angle difference between the retracted position and the abutting position is 180 degrees. The lateral side of the pushing member 50' is similar to a fan shape, with an arc-shaped abutting portion, and its arc center is located apart from the second axis A2. When the pushing member 50' is in the retracted position shown in FIG. 17, the swing seat 41' is not pushed, so that the bottom edge of the wheel 43' and the bottom of the support foot 32' are located on a plane P at the same time. When the pushing member 50' is in the abutting position shown in FIG. 19, the upper end of the swing seat 41' is pushed forward by the abutting potion of the pushing member 50', so that the wheel 43' is lower than the support foot 32', causing the frame 11' to be lifted from the first height H1 shown in FIG. 17 to the second height H2 shown in FIG. 19.

Figure 18:
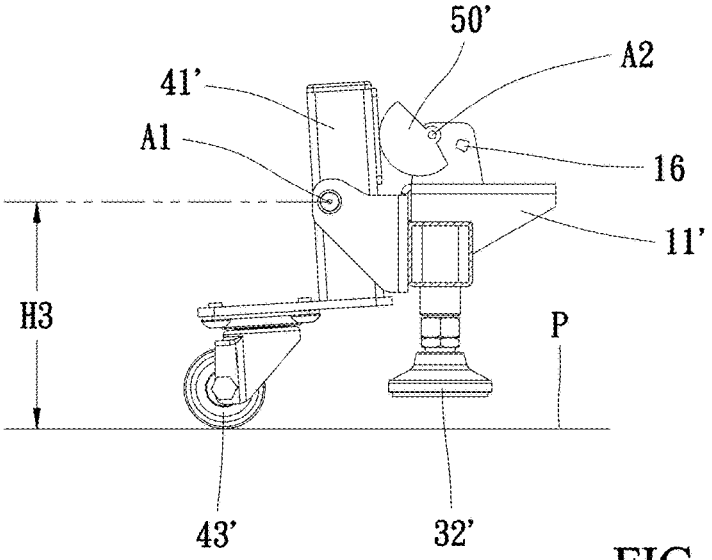

When the pushing member 50' is operated to rotate between the retracted position and the abutting position, it will pass through a temporary position shown in FIG. 18. When the pushing member 50' is located at the temporary position, since the distance from the portion of the pushing member 50' where the abutting portion abuts the swing seat 41' to the second axis A2 is the largest, the wheel 43' will be lowered to the lowest height, causing the frame 11' to rise to a third height H3 higher than the second height H2. In other words, when the pushing member 50' is operated to rotate from the retracted position to the abutting positon, the swing seat 41' will swing widely around the first axis A1 from the angle shown in FIG. 17 to the angle shown in FIG. 18 along a wheel lowering direction (corresponding to the counterclockwise direction in the figure); then, the swing seat 41' will swing slightly to the angle shown in FIG. 19 along a wheel raising direction (corresponding to the clockwise direction in the figure). Correspondingly, the frame 11' will rise significantly from the first height H1 shown in FIG. 17 to the third height H3 shown in FIG. 18, and then slightly lower to the second height H2 shown in FIG. 19.

Figure 19:
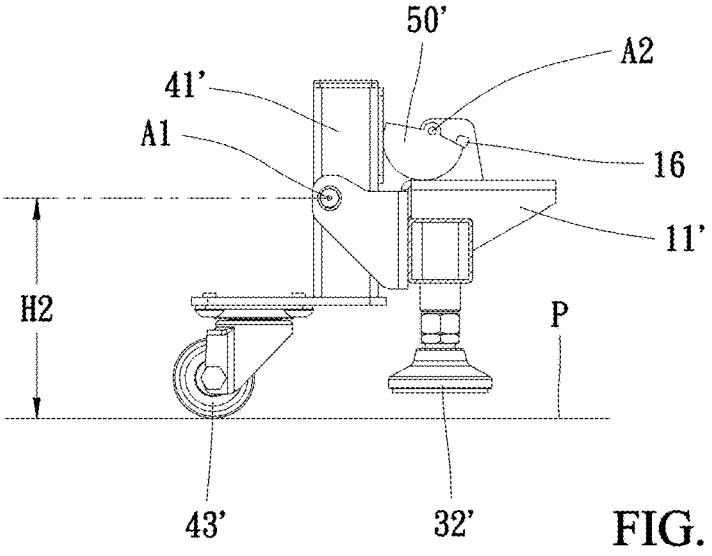

As shown in FIG. 19, when the pushing member 50' is in the abutting position, the location where the abutting portion contacts the swing seat 41' is located in front of and below the second axis A2. Thereby, when the pushing member 50' is located at the abutting position and the wheel 43' is supported against the plane P, the height-adjustable wheel set is subject to a reaction force from the plane P due to the weight of the frame 11'. The direction of the reaction force applied to the swing seat 41' corresponds to the wheel raising direction (i.e. the clockwise direction in the figure). At the same time, the direction of the reaction force applied to the pushing member 50' corresponds to the forward direction (i.e. the counterclockwise direction in the figure). Similarly, since the pushing member 50' is restricted from rotating in the forward direction from the abutting position, in the absence of sufficient force to cause the pushing member 50' to rotate in the reverse direction, the height-adjustable wheel set can be stabilized in the state shown in FIG. 19.

Figure 20:
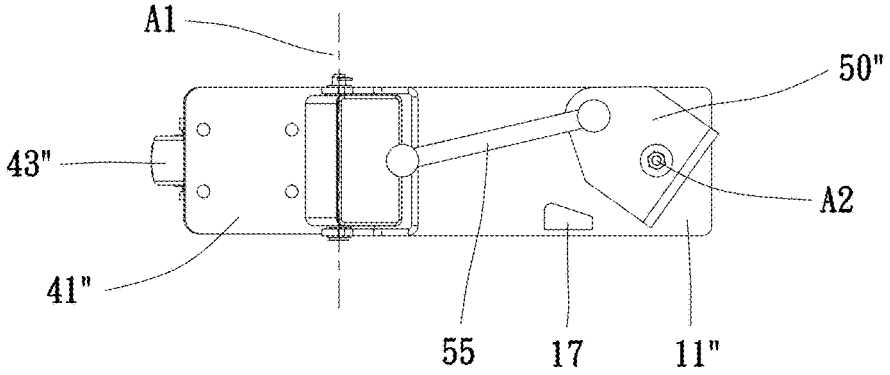
FIGS. 20 to 22 are side views of the height-adjustable wheel set in accordance with a third preferred embodiment of the present invention, showing the pushing member in the retracted position, temporary position, and abutting position in sequence.
Figure 22:
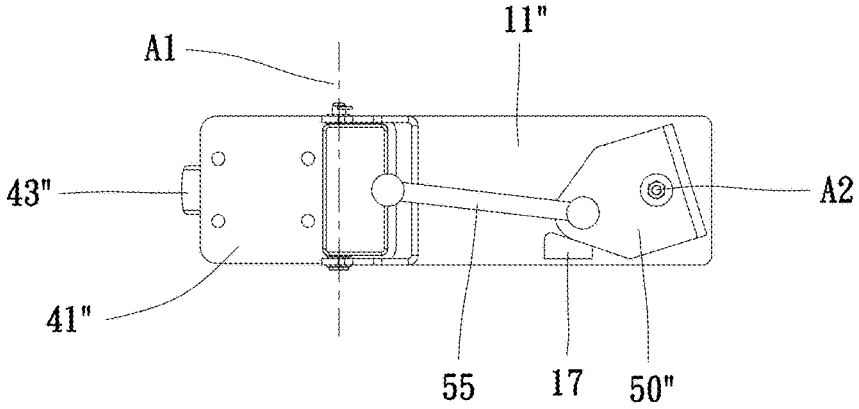

FIG. 20 is a top view of another height-adjustable wheel set in accordance with a third preferred embodiment of the present invention. The height-adjustable wheel set mainly includes a swing seat 41", a wheel 43", a pushing member 50", and a connecting rod 55. The structures of the swing seat 41" and the wheel 43" are the same as those of the previous embodiment. The pushing member 50" is pivotally mounted on the bottom of the frame 11" of the health equipment according to a vertical second axis A2. The pushing member 50" is relatively located behind the upper portion of the swing seat 41", which is rotatable around the second axis A2 between a retracted position shown in FIG. 20 and an abutting position shown in FIG. 22. The frame 11" is provided with a stopper 17 that directly restricts the rotation of the pushing member 50", so that the pushing member 50" can only rotate to the abutting position in a forward direction (corresponding to the counterclockwise direction in the figure). The angle difference between the retracted position and the abutting position is approximately 17 degrees. The two ends of the connecting rod 55 are respectively connected to the top end of the swing seat 41" and the pushing member 50" through spherical bearings. When the pushing member 50" is in the retracted position shown in FIG. 20, the top end of the swing seat 41" is pulled backward through the connecting rod 55, so that the swing seat 41" is located at a first angle relative to the frame 11". At this time, the bottom edge of the wheel 43" may be slightly in contact with the ground or slightly above it. When the pushing member 50" is in the abutting position shown in FIG. 22, the top end of the swing seat 41" is pushed forward through the connecting rod 55 (note: it is equivalent to the pushing member 50" pushing the swing seat 41" indirectly), so that the swing seat 41" is swung to a second angle and the wheel 43" is lowered to touch the ground.

Figure 21:
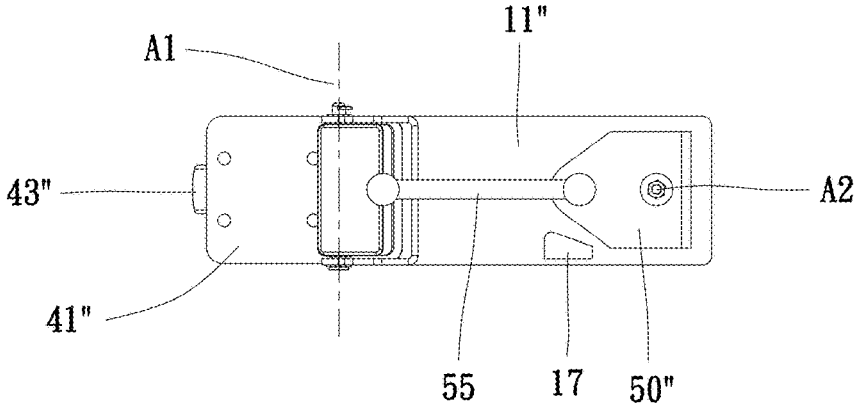

When the pushing member 50" is operated to rotate between the retraced position and the abutting position, it will pass through a temporary position shown in FIG. 21. When the pushing member 50" is located at the temporary position, the top end of the swing seat 41" is pushed forward to the frontmost position of its rotatable range through the connecting rod 55, so that the swing seat 41" swings to a third angle that is greater than the second angle and the wheel 43" is lowered to the lowest height. In other words, similar to the previous two embodiments, when the pushing member 50" is operated to rotate from the retracted position to the abutting position, the swing seat 41" will swing around the first axis A1 from the first angle to the third angle, and then return back to the second angle in the opposite direction. Correspondingly, the wheel 43" will be significantly lowered and then slightly raised. Similarly, when the pushing member 50" is in the abutting position, the direction of the reaction force applied to the pushing member 50" through the swing seat 41" from the ground corresponds to the forward direction. However, since the pushing member 50" is restricted from rotating in the forward direction from the abutting position, in the absence of sufficient force to cause the pushing member 50" to rotate in the reverse direction (and cross the temporary position), the height-adjustable wheel set can be stabilized in the state shown in FIG. 22.

In practice, the pushing members 50', 50" in the second and third embodiments can be applied to a linkage mechanism similar to the first embodiment or other types, allowing the user to operate the linkage mechanism to drive the pushing members 50', 50" to rotate in the forward or reverse direction. Depending on the implementation choice, the linkage mechanism may not be equipped in the present invention. For example, the user can manually rotate or use a wrench or other tools to rotate the aforementioned pushing members. In another embodiment, the aforementioned pushing members may be driven by electric mechanisms such as motors.

The height-adjustable wheel set in the present invention is not limited to two sets. For example, a single height-adjustable wheel set can be mounted in the center of the rear end of the frame and cooperated with the left and right caster wheels at the front end of frame, so that the health equipment can slide on the ground under the mobile mode.

In short, the health equipment in the present invention is capable of switching between a stabilizing mode for resting on the ground and a mobile mode for sliding on the ground. Depending on the implementation choice, the health equipment is provided for allowing the user to manually switch between the stabilizing mode and the mobile mode, with low cost and easy operation. Furthermore, the health equipment can switch to sable mode or mobile mode by controlling the wheel to roll on the ground or not, and the wheel can be maintained in either stabilizing mode or mobile mode, and it will not accidentally change its state.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An exercise apparatus, comprising:

a frame, having a plurality of support members mounted on a bottom of the frame, the frame adapted to be rested on a floor surface via the support members, when the exercise apparatus is in use, at least one of the support members is unable to roll on the floor surface; and at least one height-adjustable wheel set, having a swing seat, a wheel and a pushing member, the swing seat pivotally mounted on the bottom of the frame about a first axis, the wheel pivotally mounted on the swing seat and will move up or down with respect to the frame while the swing seat rotates about the first axis, the pushing member movably mounted between the frame and the swing seat, wherein when the pushing member is in a first position, the swing seat rotates to a first angle so that a bottom edge of the wheel is not lower than the support member that is unable to roll, and wherein when the pushing member is in a second position, the swing seat rotates to a second angle so that the bottom edge of the wheel is lower than the support member that is unable to roll;

wherein the pushing member is operated to be movable between the first and second positions by rotating less than 360 degrees with respect to the frame around a second axis; when the pushing member is in the second position and pushes the swing seat directly or indirectly at the second angle, the height-adjustable wheel set is subjected to a reaction force from the floor surface due to the weight of the frame; and wherein the reaction force is applied to the swing seat in a direction corresponding to a rotational direction of the swing seat about the first axis from the second angle to the first angle; at the same time, the reaction force is applied to the pushing member in a direction corresponding to a rotational direction of the pushing member about the second axis from the first position to the second position.

2. The exercise apparatus as claimed in claim 1, wherein the swing seat is operable to rotate about the first axis to a third angle, the height of the wheel relative to the frame when the swing seat is in the third angle is lower than the height of the wheel relative to the frame when the swing seat is in the second angle; wherein when the swing seat rotates from the first angle to the third angle, the bottom edge of the wheel does not pass under the first axis; and wherein when the pushing member rotates between the first and second positions, the pushing member will pass a third position where the swing seat is directly or indirectly abutted by the pushing member at the third angle.

3. The exercise apparatus as claimed in claim 2, further comprising a linkage mechanism coupled to the pushing member of each height-adjustable wheel set, the linkage mechanism having an operating portion for being manually operated by a user; wherein when the operating portion is located at an initial position, the pushing member is located at the first position; when the operating portion is located at an end position, the pushing member is located at the second position; and wherein when the operating portion is operated from the initial position to the end position, it will pass an intermediate position where the pushing member is located at the third position.

4. The exercise apparatus as claimed in claim 3, wherein the pushing member has an arc-shaped abutting portion, and the center of the abutting portion is located apart from the second axis; the pushing member is kept in contact with the swing seat with the abutting portion, at least when the bottom edge of the wheel is lower than the support member that is unable to roll; and wherein the pushing member will contact the swing seat with different portions on an arc of the abutting portion as the pushing member rotates around the second axis.

5. The exercise apparatus as claimed in claim 4, wherein the linkage mechanism has at least one rotating member that matches the at least one height-adjustable wheel set, and each rotating member is pivotally mounted to the frame according to the corresponding second axis so that each rotating member is capable of being driven by movement of the operating portion to rotate around the corresponding second axis; and wherein the pushing member of each height-adjustable wheel set is circular, and its circumference forms the abutting portion, and the pushing member is pivotally mounted to the rotating member about a third axis that is parallel to the second axis.

6. The exercise apparatus as claimed in claim 5, wherein the exercise apparatus comprises two of the height-adjustable wheel sets; the linkage mechanism comprises two of the rotating members and a connecting rod, and the two rotating members are rotatable about the respective second axes that are parallel to each other; and wherein the connecting rod has two ends respectively pivotally connected to parts of the two rotating members away from the respective second axes, so that the two rotating members can rotate synchronously.

7. The exercise apparatus as claimed in claim 3, wherein the linkage mechanism has an operating lever disposed at the bottom of the frame, which is operable to rotate about a vertical axis with respect to the frame; the longitudinal direction of the operating lever is perpendicular to the vertical axis, and one end of the operating lever is provided with the operating portion; the operating portion is operated to be moved between the initial position and the end position by rotating around the vertical axis; and wherein the initial position is located at right side or left side of the frame, and the end position is located at rear side of the frame.

8. The exercise apparatus as claimed in claim 7, wherein the operating lever is a telescopic rod that can be extended or shortened along its longitudinal axis; when the operating lever is shortened to a shortest length and the operating portion is located at the initial position, the entire operating lever is located within an outer edge of the bottom of the exercise apparatus; and wherein when the operating lever is extended to a longest length, the operating lever will remain outside the outer edge of the bottom of the exercise apparatus during the movement between the initial position and the end position.

9. The exercise apparatus as claimed in claim 8, wherein the operating lever is continuously acted upon by an elastic force, causing the operating lever to have a tendency to shorten to the shortest length.

10. The exercise apparatus as claimed in claim 3, wherein the frame has a first stop portion and a second stop portion; when the operating portion of the linkage mechanism is located at the initial position, the linkage mechanism partially abuts against the first stop portion; and when the operating portion is located at the end position, the linkage mechanism partially abuts against the second stop portion, thereby limiting a movement range of the operating portion and a rotatable range of the pushing member.

11. A health apparatus, comprising:

a frame, having a plurality of support members mounted on a bottom of the frame, the frame adapted to be rested on a floor surface via the support members, when the health equipment is in use, at least one of the support members is unable to roll on the floor surface; and at least one height-adjustable wheel set, comprising:

a swing seat, pivotally mounted on the bottom of the frame about a first axis;

a wheel, pivotally mounted on the swing seat and being capable of moving up or down with respect to the frame as the swing seat rotates about the first axis; and a pushing member, movably mounted between the frame and the swing seat and being limited to be movable with respect to the frame between a retracted position and an abutting position around a second axis, when the pushing member is in the retracted position, the swing seat rotates to a first angle so that a bottom edge of the wheel is not lower than the support member that is unable to roll, when the pushing member is in the abutting position, the swing seat rotates to a second angle so that the bottom edge of the wheel is lower than the support member that is unable to roll;

wherein when the pushing member is in the abutting position and pushes the swing seat at the second angle, the height-adjustable wheel set is subjected to a reaction force from the floor surface due to the weight of the frame, the reaction force applied to the swing seat in a direction corresponding to a rotational direction of the swing seat about the first axis from the second angle to the first angle, at the same time, the reaction force applied to the pushing member in a direction corresponding to a rotational direction of the pushing member about the second axis from the retracted position to the abutting position.

12. The health equipment as claimed in claim 11, wherein the swing seat is operable to rotate about the first axis to a third angle, the height of the wheel relative to the frame when the swing seat is in the third angle is lower than the height of the wheel relative to the frame when the swing seat is in the second angle; wherein when the swing seat rotates from the first angle to the third angle, the bottom edge of the wheel does not pass below the first axis; and wherein when the pushing member rotates between the retracted and abutting positions, the pushing member will pass a temporary position where the swing seat is abutted by the pushing member at the third angle.

13. The health equipment as claimed in claim 12, further comprising a linkage mechanism coupled to the pushing member of each height-adjustable wheel set, the linkage mechanism having an operating portion for being manually operated by a user; wherein when the operating portion is located at an initial position, the pushing member is located at the retracted position; when the operating portion is located at an end position, the pushing member is located at the abutting position; and wherein when the operating portion is operated from the initial position to the end position, it will pass an intermediate position where the pushing member is located at the temporary position.

14. The health equipment as claimed in claim 13, wherein the pushing member has an arc-shaped abutting portion, and the center of the abutting portion is located apart from the second axis; the pushing member is kept in contact with the swing seat with the abutting portion, at least when the bottom edge of the wheel is lower than the support member that is unable to roll; and wherein the pushing member will contact the swing seat with different portions on an arc of the abutting portion as the pushing member rotates around the second axis.

15. The health equipment as claimed in claim 14, wherein the linkage mechanism has at least one rotating member that matches the at least one height-adjustable wheel set, and each rotating member is pivotally mounted to the frame according to the corresponding second axis so that each rotating member is capable of being driven by movement of the operating portion to rotate around the corresponding second axis; and wherein the pushing member of each height-adjustable wheel set is circular, and its circumference forms the abutting portion, and the pushing member is pivotally mounted to the rotating member about a third axis that is parallel to the second axis.

16. The health equipment as claimed in claim 15, wherein the health equipment comprises two of the height-adjustable wheel sets; the linkage mechanism comprises two of the rotating members and a connecting rod, and the two rotating members are rotatable about the respective second axes that are parallel to each other; and wherein the connecting rod has two ends respectively pivotally connected to parts of the two rotating members away from the respective second axes, so that the two rotating members can rotate synchronously.

17. The health equipment as claimed in claim 13, wherein the linkage mechanism has an operating lever disposed at the bottom of the frame, which is operable to rotate about a vertical axis with respect to the frame; the longitudinal direction of the operating lever is perpendicular to the vertical axis, and one end of the operating lever is provided with the operating portion; the operating portion is operated to be moved between the initial position and the end position by rotating around the vertical axis; and wherein the initial position is located at right side or left side of the frame, and the end position is located at rear side of the frame.

18. The health equipment as claimed in claim 17; wherein the operating lever is a telescopic rod that can be extended or shortened along its longitudinal axis; when the operating lever is shortened to a shortest length and the operating portion is located at the initial position, the entire operating lever is located within an outer edge of the bottom of the health equipment; and wherein when the operating lever is extended to a longest length, the operating lever will remain outside the outer edge of the bottom of the health equipment during the movement between the initial position and the end position.

19. The health equipment as claimed in claim 13, wherein the frame has a first stop portion and a second stop portion; when the operating portion of the linkage mechanism is located at the initial position, the linkage mechanism partially abuts against the first stop portion; and when the operating portion is located at the end position, the linkage mechanism partially abuts against the second stop portion, thereby limiting a movement range of the operating portion and a rotatable range of the pushing member.

20. An exercise apparatus, comprising:

a frame, having two support feet disposed at a bottom near a rear end of the frame and two caster wheels disposed at the bottom near a front end of the frame, the two support feet being unable to roll on the floor surface so that the frame can be stably rested on a floor surface via the two support feet and the two caster wheels; and at least one height-adjustable wheel set arranged near the two support feet, comprising:

a swing seat, pivotally mounted on the bottom of the frame about a first axis;

a wheel, pivotally mounted on the swing seat and being capable of moving up or down with respect to the frame as the swing seat rotates about the first axis; and a pushing member, movably mounted between the frame and the swing seat and being limited to be movable with respect to the frame between a retracted position and an abutting position around a second axis, when the pushing member is in the retracted position, the swing seat rotates to a first angle so that a bottom edge of the wheel is not lower than the two support feet, when the pushing member is in the abutting position, the swing seat rotates to a second angle so that the bottom edge of the wheel is lower than the two support feet for allowing the exercise apparatus to slide on the floor surface;

wherein when the pushing member is in the abutting position and pushes the swing seat at the second angle, the height-adjustable wheel set is subjected to a reaction force from the floor surface due to the weight of the frame, the reaction force applied to the swing seat in a direction corresponding to a rotational direction of the swing seat about the first axis from the second angle to the first angle, at the same time, the reaction force applied to the pushing member in a direction corresponding to a rotational direction of the pushing member about the second axis from the retracted position to the abutting position.

* * * * *